US008175475B2

(12) United States Patent
Inami et al.

(10) Patent No.: US 8,175,475 B2
(45) Date of Patent: May 8, 2012

(54) IMAGE FORMING APPARATUS

(75) Inventors: Satoru Inami, Yokohama (JP); Nobuyoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/876,617

(22) Filed: Sep. 7, 2010

(65) Prior Publication Data

US 2011/0058834 A1 Mar. 10, 2011

(30) Foreign Application Priority Data

Sep. 8, 2009 (JP) ..... 2009-206665

(51) Int. Cl.
*G03G 15/02* (2006.01)

(52) U.S. Cl. ..... 399/50

(58) Field of Classification Search ..... 399/26, 399/28, 48, 49, 50, 55, 66, 73, 168, 169, 399/174, 176, 255, 258, 270, 274, 285, 297, 399/307, 310, 313, 345, 350, 351; 361/225, 361/222

See application file for complete search history.

(56) References Cited

U.S. PATENT DOCUMENTS

| | | | | |
|---|---|---|---|---|
| 4,851,960 | A | 7/1989 | Nakamura et al. | |
| 5,006,902 | A * | 4/1991 | Araya | 399/168 |
| 5,649,268 | A * | 7/1997 | Maebashi et al. | 399/168 |
| 5,682,585 | A | 10/1997 | Yamaguchi et al. | |
| 5,805,951 | A | 9/1998 | Kato et al. | |
| 6,128,461 | A | 10/2000 | Yoshikawa | |
| 6,163,663 | A | 12/2000 | Shinohara et al. | |
| 6,735,402 | B2 * | 5/2004 | Oki | 399/66 |
| 6,970,661 | B2 | 11/2005 | Shoji | |
| 7,162,173 | B2 * | 1/2007 | Motohashi et al. | 399/50 |
| 7,174,112 | B2 * | 2/2007 | Motohashi et al. | 399/66 |
| 7,194,215 | B2 * | 3/2007 | Okano et al. | 399/50 |
| 7,444,092 | B2 | 10/2008 | Naito et al. | |
| 7,835,655 | B2 * | 11/2010 | Kobashi et al. | 399/50 |
| 2005/0260006 | A1 * | 11/2005 | Matsuda et al. | 399/50 |
| 2008/0080885 | A1 * | 4/2008 | Kidaka | 399/66 |

FOREIGN PATENT DOCUMENTS

| | | | |
|---|---|---|---|
| JP | 3-52058 | B | 8/1991 |
| JP | 11-174922 | A | 7/1999 |
| JP | 2004-170956 | A | 6/2004 |
| JP | 2007-164044 | A | 6/2007 |

* cited by examiner

*Primary Examiner* — Kiho Kim
(74) *Attorney, Agent, or Firm* — Fitzpatrick, Cella, Harper & Scinto

(57) ABSTRACT

An image forming apparatus includes a rotatable image bearer for carrying a toner image, a charger for contacting a surface of the image bearer, a cleaning blade for contacting the image bearer surface to remove toner thereon after toner image transfer onto a transfer material, and a controller for controlling a voltage applied to the charger. The controller applies to the charger a first potential which includes a peak-to-peak voltage larger than a discharge starting voltage in an image forming operation, and applies to the charger a second voltage which includes a peak-to-peak voltage smaller than the discharge starting voltage, for at least one full rotation of the image bearer, after completion of image formation and before an AC voltage component applied to the charger is shut off.

3 Claims, 3 Drawing Sheets

(a)

(b)

IMAGE FORMING APPARATUS

FIELD OF THE INVENTION AND RELATED ART

The present invention relates to an electrophotographic image forming apparatus.

An electrophotographic image forming apparatus has a charging member for uniformly charging the peripheral surface of a photosensitive drum as an image bearing member. As for methods for charging a photosensitive drum, there are a charging method of the contact type, and a charging method of the non-contact type, for example, the charging method of corona discharge type. From the standpoint of the minimization of the amount of byproducts of electrical discharge, and also, cost reduction, the charging method of the contact type has become mainstream (U.S. Pat. No. 4,851,960). Incidentally, "byproducts of electrical discharge" is the general term for products which result when the peripheral surface of a photosensitive drum is charged. Some of them reduce the peripheral surface of the photosensitive drum in electrical resistance, whereas others may contaminate a charging member, causing electrical insulation failure, unsatisfactory charging of the photosensitive drum, etc.

U.S. Pat. No. 6,970,661 discloses one of the methods for minimizing or eliminating the above-described problem. According this patent, in order to minimize the amount by which byproducts are generated by electrical discharge in an image forming apparatus which employs a charge roller, the voltage to be applied to a charge roller is lowered when the portion of the peripheral surface of a photosensitive drum, across which no image is formed, that is, the portion which corresponds to the interval between the adjacent two sheets of recording medium conveyed by a recording medium conveying means, is charged. To the charge roller, a combination of an AC voltage and a DC voltage is applied. However, the AC voltage to be applied to the charge roller to charge the portion of the peripheral surface of the photosensitive drum, across which no image is to be formed, is set to be no higher in peak-to-peak voltage than the AC voltage to be applied to the charge roller for image formation, and no lower in peak-to-peak voltage than the discharge start voltage (twice discharge start voltage in peak-to-peak voltage).

On the other hand, in recent years, image forming apparatuses equipped with a cleaning member of the contact type, that is, the cleaning member to be placed in contact with the peripheral surface of a photosensitive drum to scrape away the residual toner on the peripheral surface of a photosensitive drum, have been seen with increasing frequency. In the case of an image forming apparatus having the above described cleaning member, it is possible that some of the residual toner on the peripheral surface of the photosensitive drum slips by the cleaning member, resulting in the formation of image defects such as black streaks, and the like. It is possible to increase an image forming apparatus in the contact pressure between the cleaning means and photosensitive drum in order to prevent the formation of the image defects. Further, as the photosensitive drum is rotated, the cleaning member sometimes sticks and slips, allowing thereby the residual toner to slip by the cleaning member. In comparison, U.S. Pat. No. 6,128,462 discloses an image forming apparatus provided with a device for vibrating the cleaning member to minimize the phenomenon that the cleaning member sticks and slips.

The above-described conventional image forming apparatuses which employ a charging member of the contact type, to which a combination of an AC voltage and a DC voltage is applied, and also, a cleaning blade, suffer from the following problems.

It has been known that when a conventional image forming apparatus is used for image formation, image defects attributable to the imperfect cleaning of the peripheral surface of the photosensitive drum by the cleaning member are likely to occur across the leading edge portion of the first sheet of recording medium in a given printing job (they gradually reduce as image forming apparatus continues). These image defects were more conspicuous when temperature was low than when it is normal. The studies earnestly made about this phenomenon by the inventors of the present invention revealed that the cleaning failure which occurred immediately after the AC voltage which was being applied to the charging member was turned off after the completion of a given printing job was more serious than those which occurred in other situations. Next, the process in which cleaning failure occurs after the AC voltage which is being applied to the charging member is turned off will be described.

As a combination of an AC voltage and a DC voltage is applied to the charging member of an image forming apparatus during an image forming operation, foreign compounds (byproducts) are generated on the peripheral surface of the photosensitive drum by electrical discharge. These byproducts increases the peripheral surface of the photosensitive drum in frictional resistance. The increase in frictional resistance of the peripheral surface of the photosensitive drum increases the cleaning member in the amount by which it sticks and slips, and the frequency with which it sticks and slips, which makes it likely for the image forming apparatus to output defective images. However, while an AC voltage is applied to the charging member, the charge roller and photosensitive drum are made to vibrate by the AC voltage. This vibration causes the contact pressure between the cleaning member and photosensitive drum to minutely change. Therefore, the cleaning member is reduced in the amount and frequency of "stick-and-slip phenomenon", being enabled to continuously and satisfactorily clean the peripheral surface of the photosensitive drum.

As the AC voltage being applied to the charging member is turned off in the post-procedure, the charge roller and photosensitive drum stop vibrating, and therefore, the cleaning member increases in the amount by which the cleaning member sticks and slips, and the frequency with which it sticks and slips. Further, the foreign substances are continuously generated on the peripheral surface of the photosensitive drum by the AC voltage applied to the charging member until the AC voltage is turned off. Thus, the presence of these foreign substances (byproducts of charging of photosensitive drum) on the peripheral surface of the photosensitive drum 1, causes the peripheral surface of the photosensitive drum to be significantly higher in frictional resistance than before the peripheral surface of the photosensitive drum begins to be charged. The increase in the frictional resistance of the peripheral surface of the photosensitive drum 1 causes the cleaning member to stick and slip. Further, the image forming apparatus is provided with no means for reducing the stick-and-slip phenomenon. Therefore, it becomes likely for the residual toner to slip by the cleaning member. In other words, the cleaning member is likely to fail to satisfactorily clean the photosensitive drum. As for the portion of the residual toner, which slipped by the cleaning member, it does not immediately vanish; it is likely to appears as image defects, such as black streaks and the like, on the sheet of recording medium. Thus, the portion of the image, which will be formed on the leading end portion of the first sheet of recording medium in the next printing job, is likely to be defective.

As described above, if the AC voltage, which is being applied, in combination with a DC voltage, to the charging member is turned off in the post-procedure, defective images are outputted, the defects of which are attributable to the unsatisfactory cleaning of the photosensitive drum by the cleaning member. However, even if the AC voltage, which is being applied to the charging member, is not turned off in the post-procedure, and is reduced to a level which is lower than the level at which it was during the image formation, and higher than the discharge start voltage, as disclosed in U.S. Pat. No. 6,970,661, the following problem occurs.

In the case of the method disclosed in U.S. Pat. No. 6,970,661, the cleaning member is reduced in the "stick-and-slip phenomenon", by applying the AC voltage to the charging member even after the completion of image formation. However, the AC voltage is no lower than the discharge start voltage, and therefore, the peripheral surface of the photosensitive drum will be strewn with the byproduct of the charging of the photosensitive member. Thus, the peripheral surface of the photosensitive drum further increases in frictional resistance. That is, it is difficult to satisfactorily reduce the "stick-and-slip phenomenon" by the application of the above-described AC voltage to the charging member immediately after the completion of an image forming operation. In other words, some of the residual toner slips by the cleaning member, and causes the image forming apparatus to output defective images, the defects of which are attributable to the unsatisfactory cleaning of the peripheral surface of the photosensitive drum by the cleaning member.

SUMMARY OF THE INVENTION

The primary object of the present invention is to provide an image forming apparatus which applies a combination of AC voltage and a DC voltage to its charging member, has a cleaning member, and yet, does not fail to satisfactorily clean its photosensitive member, and therefore, can continuously output high quality images.

According to an aspect of the present invention, there is provided a An image forming apparatus comprising a rotatable image bearing member for carrying a toner image; a charging member for contacting a surface of the image bearing member to discharge the surface; a cleaning blade for contacting the surface of the image bearing member to remove toner remaining on the surface of the image bearing member after a toner image is transferred from said image bearing member onto a transfer material; and a control device for controlling a voltage applied to said charging member; wherein the control device applies to the charging member a first charged potential which includes a peak-to-peak voltage larger than a discharge starting voltage in image forming operation, and applies to the charging member a second voltage which includes a peak-to-peak voltage is smaller than the discharge starting voltage, for at least one full rotation of said image bearing member, after completion of the image forming operation and before an AC voltage component applied to the charging member is shut off.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

(1-1: General Structure of Image Forming Apparatus)

Figure 2:
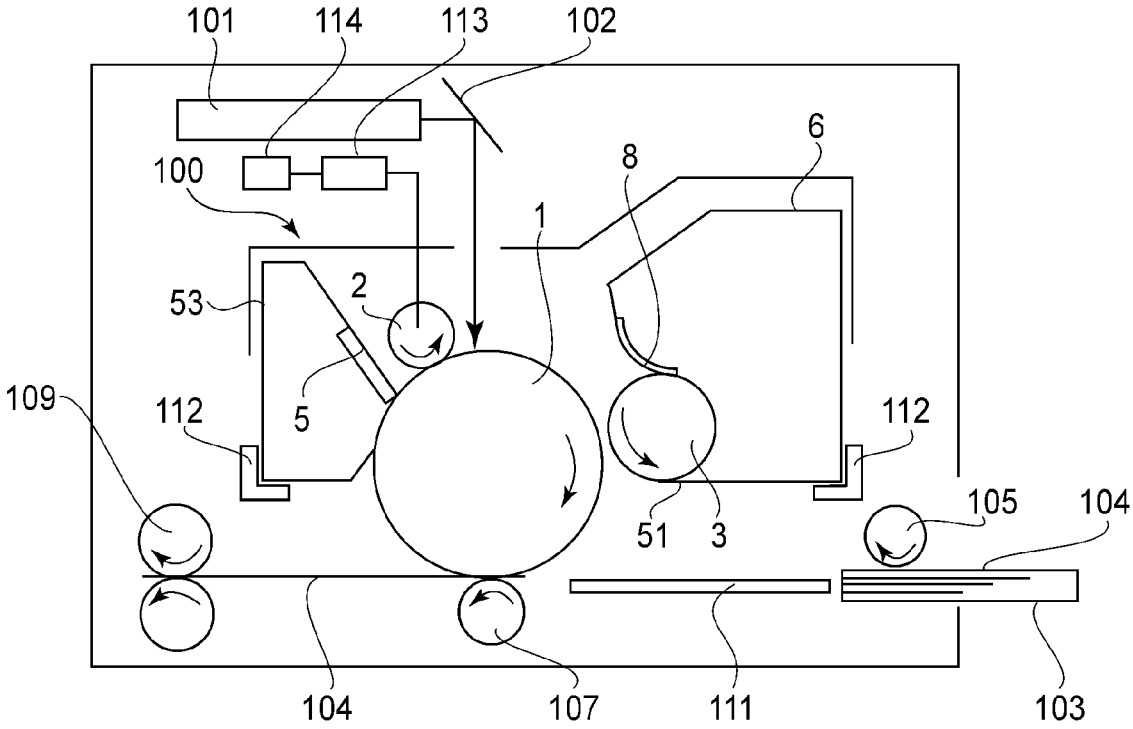
FIG. 2 is a schematic sectional view of the image forming apparatus in the first embodiment of the present invention, and shows the structure of the apparatus.

First, referring to FIG. 2, the image forming apparatus in the first preferred embodiment of the present invention will be described about its general structure. FIG. 2 is a schematic sectional view of the image forming apparatus in this embodiment. It shows the general structure of the apparatus. The image forming apparatus in this embodiment is an electrophotographic laser beam printer.

Referring to FIG. 2, the image forming apparatus has a photosensitive drum1, a charge roller (charging member). The photosensitive drum 1 is an image bearing member which is rotatable in the direction indicated by an arrow mark in the drawing. The charge roller 2 uniformly charges the peripheral surface of the photosensitive drum 1 to the same polarity as toner, by being placed in contact with the peripheral surface of the photosensitive drum 1. The photosensitive drum 1 is organic and is 24 mm in diameter. When the apparatus is used for forming an image on a sheet of recording medium (that is, medium on which image is formed), the following processes are carried out: First, the peripheral surface of the photosensitive drum 1 is uniformly charged by the charge roller 2. Then, only the charged portion of the peripheral surface of the photosensitive drum 1 is scanned with (exposed to) a beam of laser light which is outputted from a scanner unit 101, while being modulated with the image signals, and deflected by a deflection mirror 102. As a result, an electrostatic latent image is formed on the charged and scanned portion of the peripheral surface of the photosensitive drum 1.

The image forming apparatus has also a developing apparatus 51, which is in the adjacencies of the peripheral surface of the photosensitive drum 1. The electrostatic latent image is developed into a visible image formed of toner (which hereafter will be referred to as toner image), by supplying the electrostatic latent image with toner (developer) from the developer container 6 of the developing apparatus 51. As for the method for supplying the electrostatic latent image with toner, as the development sleeve 3 of the developing apparatus 51 is rotated, a certain amount of toner in the toner container 6 is borne on the peripheral surface of the development sleeve 3, and then, is rubbed by the development blade 8, whereby the toner on the peripheral surface of the development sleeve 3 is frictionally charged. Further, a preset development voltage is applied to the development sleeve 3 from an unshown electric power source. Thus, the frictionally charged toner on the development sleeve 3 is electrostatically transferred (supplied) onto the electrostatic latent image on the peripheral surface of the photosensitive drum 1.

A sheet 104 of recording medium is the object onto which the aforementioned visible image is to be transferred. The image forming apparatus is also provided with a sheet feeder cassette 103, in which multiple sheets 104 of recording medium are stored. The sheets 104 in the sheet feeder cassette 103 are conveyed out of the cassette 103 one by one by a sheet feeder roller 105, and then, are conveyed one by one to the nip (transfer nip) between the photosensitive drum 1 and a transfer roller 107, with a preset timing, through a sheet conveyance guide 111, etc. In the transfer nip, the toner image is electrostatically transferred onto the sheet 104 from the peripheral surface of the photosensitive drum 1, by the function of the transfer voltage applied to the transfer roller 107 from an unshown electric power source. After the transfer of the toner image, the sheet 104, on which the toner image is present, is conveyed to a fixing apparatus 109. In the fixing apparatus 109, pressure and heat are applied to the sheet 104 and the toner image thereon. Consequently, the toner image on the sheet 104 becomes fixed to the sheet 104. After the fixation of the toner image to the sheet 104, the sheet 104 is discharged from the main assembly of the image forming apparatus. Incidentally, the image forming apparatus in this embodiment is 150 mm/sec in process speed.

After the transfer of the toner image onto the sheet 104, the toner particles which failed to transfer onto the sheet 104 remain on the peripheral surface of the photosensitive drum 1 (these toner particles hereafter will be collectively referred to as transfer residual toner). If the transfer residual toner is left unattended on the peripheral surface of the photosensitive drum 1, it is possible that an unsatisfactory image, for example, an image suffering from a "ghost" or the like, will be formed on the next sheet 104 when the next toner image is transferred from the peripheral surface of the photosensitive drum 1 onto the next sheet 104. Therefore, the image forming apparatus is provided with a cleaning member 5 for removing the transfer residual toner from the peripheral surface of the photosensitive drum 1. As the transfer residual toner is scraped away (down) from the peripheral surface of the cleaning member 5, it is stored in a cleaning means container so that the removed transfer residual toner can be reused. The cleaning member 5 will be described later in detail.

In this embodiment, the photosensitive drum 1, charge roller 2, developing apparatus 51, cleaning member 5, and transfer residual toner container 53, are integrally held in a cartridge, making up thereby a process cartridge 100. The process cartridge 100 is comprised of a unit which includes the photosensitive drum 1, charge roller 2, cleaning member 5, and transfer residual toner container 53, and a unit which includes the developing apparatus 51, etc. The process cartridge 100 is removably mountable in the main assembly of the image forming apparatus. As the process cartridge 100 is mounted into the main assembly of the image forming apparatus, it is precisely positioned relative to the process cartridge positioning internal portion of the main assembly; when the process cartridge 100 is in the apparatus main assembly, it remains properly positioned relative to the apparatus main assembly.

Next, the members listed above, and also, the members, portions, etc., of the image forming apparatus other than the members listed above will be described in more detail.

(1-2: Charge Roller)

The charge roller 2 is in contact with the peripheral surface of the photosensitive drum 1, and is rotated by the rotation of the photosensitive drum (in direction indicated by arrow mark). The charge roller 2 is in connection with a charge voltage application electric power source 113 so that a combination of an AC voltage and a DC voltage is applied from the power source 113 to the charge roller 2. The controlling portion 114 (CPU), which is a controlling apparatus, controls the charge voltage application electric power source 113 to control the AC voltage to be applied to the charge roller 2, and the DC voltage to be applied to the charge roller 2. The application of a combination of AC voltage and DC voltage, such as the above-described ones, makes it possible to reliably and uniformly charge the peripheral surface of the photosensitive drum 1. More specifically, the peripheral surface of the photosensitive drum 1 can be uniformly charged to −600 V by applying to the charge roller 2, a charge voltage which is a combination of an AC voltage which is 1,500 V in peak-to-peak voltage, and a DC voltage which is −600 V in magnitude.

Figure 3:
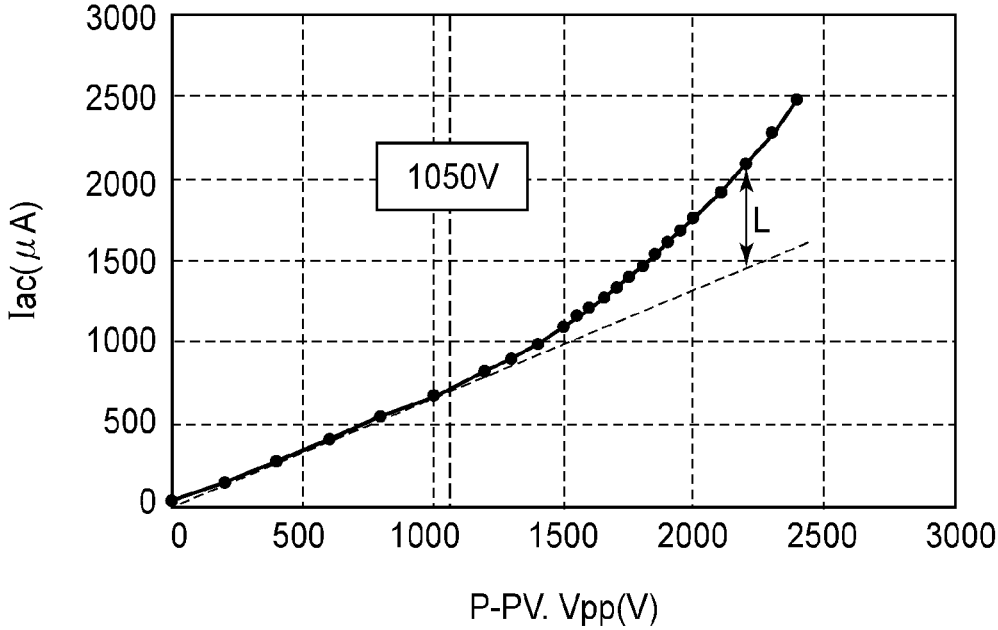
FIGS. 3(*a*) and 3(*b*) are graphs which show the properties of the charging member in terms of charging performance.
Figure 3:
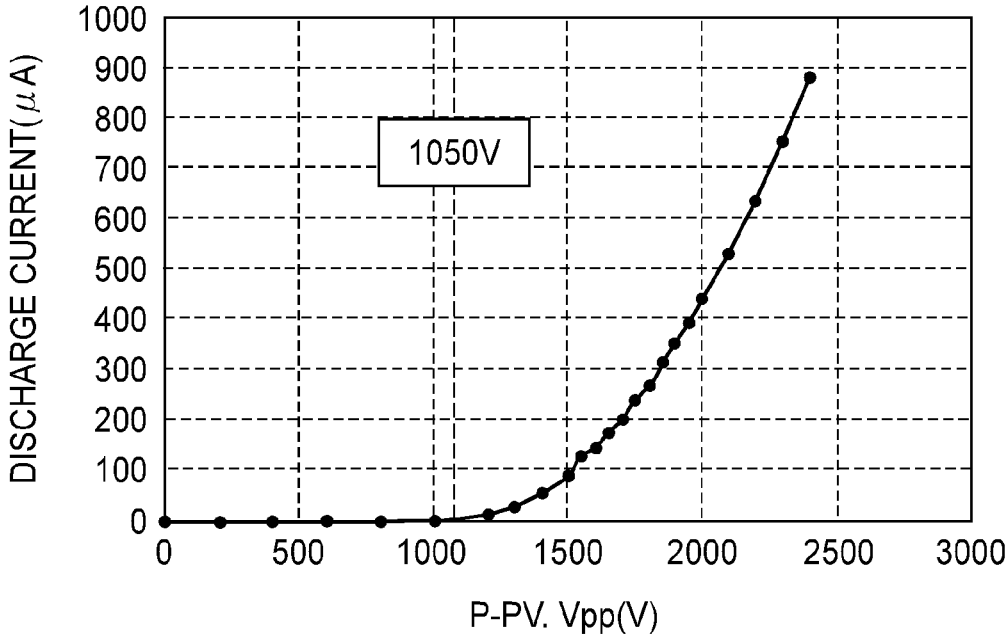

Next, referring to FIG. 3, the properties of the charge roller 2 will be described in terms of charging performance. FIG. 3(*a*) is a graph which shows the relationship between the potential (peak-to-peak voltage Vpp) of the AC voltage applied to the charge roller 2, and the amount of electric current which flowed through the charge roller 2. FIG. 3(*b*) is a graph which shows the relationship between the potential (peak-to-peak voltage Vpp) of the AC voltage applied to the charge roller 2, and the value (μA) of the electric current flowed between the charge roller 2 and photosensitive drum 1 by the electrical discharge which occurred between the charge roller 2 and photosensitive drum 1.

Referring to FIG. 3(*a*), as the AC voltage was increased in magnitude (Vpp), the rate of increase in the amount by which electric current was flowed through the charge roller 2 by the AC voltage began to increase at 1,050 Vpp. That is, as the AC voltage (Vpp) was increased beyond 1,050 Vpp, the rate with which the amount by which electric current was flowed through the charge roller 2 by the AC voltage began to increase faster than when the AC voltage was smaller than 1,050 V, as indicated by the curvature of the portion of the line in FIG. 3(*a*), which corresponds to when the AC voltage was greater than 1,050 V. This phenomenon occurred because when the AC voltage was greater than 1,050 V in peak-to-peak voltage, electrical discharge occurred between the charge roller 2 and photosensitive drum 1, whereby the amount Iac by which electric current was flowed between the charge roller 2 and photosensitive drum 1 by the AC voltage increased. Incidentally, a double-headed arrow mark L in the graph indicates the amount by which electric current was flowed by the electrical discharge between the charge roller 2 and photosensitive drum 1. That is, whether or not electric discharge occur is determined by whether or not the voltage applied to the charge roller 2 is higher than a certain value. Thus, this value is referred to as "discharge start voltage".

Next, referring to FIG. 3(*b*), it is evident from FIG. 3(*b*) that when the voltage applied to the charge roller 2 was steadily increased, the electric current flowed by electrical discharge suddenly increased in the rate of increase when the voltage applied to the charge roller 2 became greater than the "discharge start voltage (1,050 V in peak-to-peak voltage). Where the AC voltage applied to the charge roller 2 was no higher than 1,050 V in peak-to-peak voltage, the amount by which electric current was flowed by the electrical discharge was roughly 0 μA, and therefore, the peripheral surface of the photosensitive drum 1 could not be satisfactorily charged.

Further, the application of the AC voltage to the charge roller 2 generates an oscillatory electric field between the charge roller 2 and photosensitive drum 1, causing thereby the photosensitive drum 1 to minutely vibrate. This minute vibration of the photosensitive drum 1 is effective to reduce in magnitude the "stick-and-slip phenomenon" described above. Incidentally, in this embodiment, the charge roller 2 which is the member for charging the photosensitive drum 1 is placed in contact with the photosensitive drum 1. However, the choice of the charging member for charging the photosensitive drum 1 does not need to be limited to a roller. For example, a charging member which is in the form of a blade may be employed in place of the charge roller 2.

(1-3: Cleaning Member)

Figure 4:
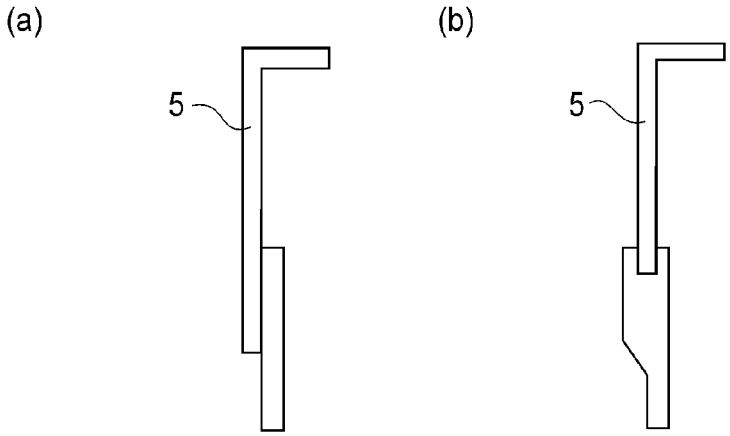
FIGS. 4(*a*) and 4(*b*) are schematic sectional views of the cleaning members, one for one, in the first embodiment of the present invention.
Figure 5:
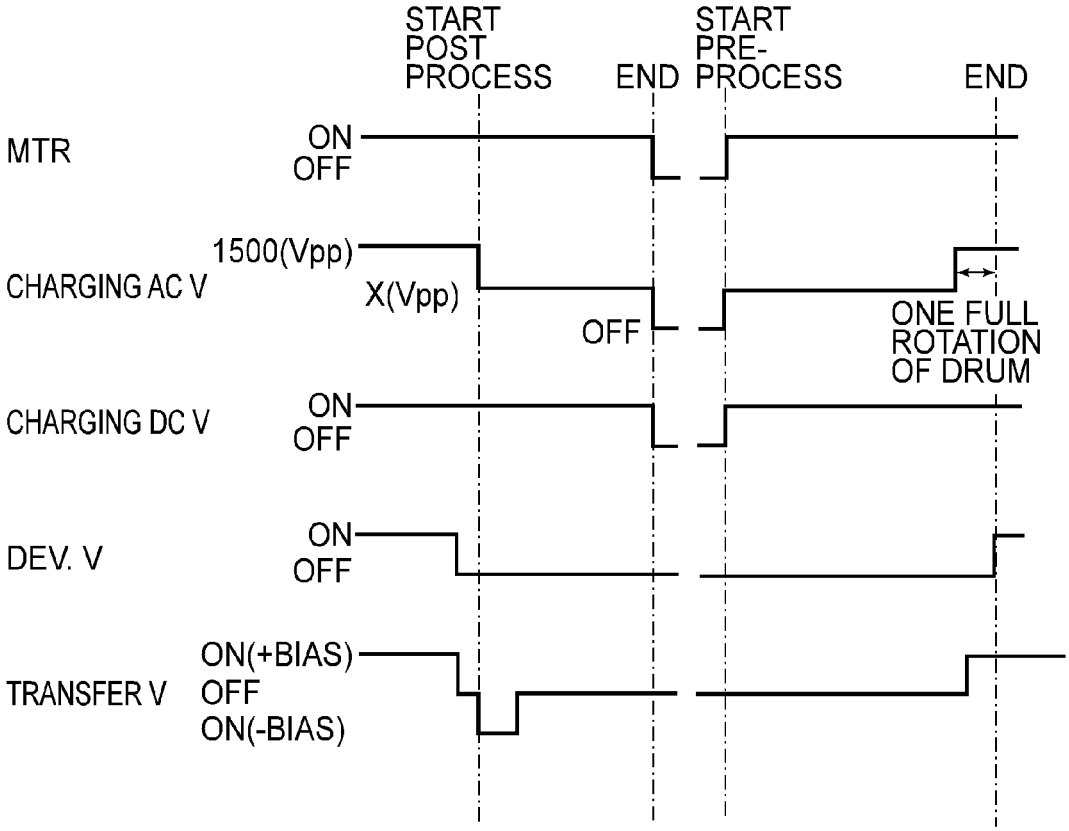
FIG. 5 is an operational chart which shows the operational sequence carried out by the image forming apparatus in the second embodiment, after the completion of an image.

FIG. 4 is a schematic drawing of the cleaning member 5 in this embodiment, and shows the structure of the cleaning member 5. The cleaning blade 5 in this embodiment is in the form of a blade (cleaning blade). The cleaning blade, that is, the cleaning member 5, is made up of a piece of metallic plate and a rubber blade. The material of which the rubber blade is made is elastic rubber, more specifically, polyurethane rubber. As for the shape of the cleaning blade in terms of the cross-section perpendicular to the rotational direction of the photosensitive drum 1, it may be uniform in thickness as shown in FIG. 5(*a*), or nonuniform as shown in FIG. 5(*b*). The cleaning member 5 is kept in contact with the peripheral surface of the photosensitive drum 1 at such an angle that its cleaning edge is on the upstream side of its base portion in terms of the rotational direction of the photosensitive drum 1.

(1-4: Developing Apparatus)

The developing apparatus 51 is provided with a rotatable sleeve 3, and a development blade for regulating in thickness the toner layer on the development sleeve 3. It is also provided with a magnet (unshown), which is inside the development sleeve 3. The provision of the magnet makes it possible for toner to be adhered, and keep adhered, to the peripheral surface of the development sleeve 3 by the magnetic force from the magnet, in the developing means container 6. After the adhesion of toner to the peripheral surface of the development sleeve 3, the toner on the peripheral surface of the development sleeve 3 is conveyed by the rotation of the development sleeve 3 toward the development area, where the toner on the peripheral surface of the development sleeve 3 faces the peripheral surface of the photosensitive drum 1, while becoming charged due to the friction among toner particles, and also, the friction between the toner and development blade 8. To the development sleeve 3, a development voltage, which is a combination of an AC voltage and a DC voltage is applied, whereby the toner on the development sleeve 3 is electrostatically made to jump onto the peripheral surface of the photosensitive drum 1, electrostatically adhering thereby to the electrostatic image on the peripheral surface of the photosensitive drum 1, in the development area.

(1-5: Toner)

In this embodiment, two kinds of toner (toner A and toner B) were used.

(Toner A)

This toner was polymeric toner manufactured by suspension polymerization. More specifically, it was manufactured using the following method. First, monomeric styrene, coloring agent, magnetic powder, polymerization initiator, cross-linking agent, charge controlling agent, and the other additives are uniformly melted or mixed, creating thereby a monomeric compound which can be polymerized. This compound is dispersed into a continuous polymerization tank (water tank, for example) which contains dispersant, with the use of an appropriate stirring device, while allowing the polymerization to continue, obtaining thereby such toner that is 6.5 μm in weight average particle diameter. To this toner, hydrophobic silica was added as external additive by one part.

(Toner B)

This toner is such toner that was obtained by pulverizing the substance manufactured by adding magnetic power, charge control agent, and wax to bonding resin, such as polyester resin. More specifically, the abovementioned substances were pulverized and mixed with the use of Henschel mixer, and were kneaded with the use of an extruder. Then, the resultant compound was pulverized. Then, hydrophobic silica was added as an external additive to the pulverized compound by 1.5 parts. The thus obtained toner was 6.5 μm in weight average particle diameter.

(1-6: Operational Sequence Chart)

Figure 1:
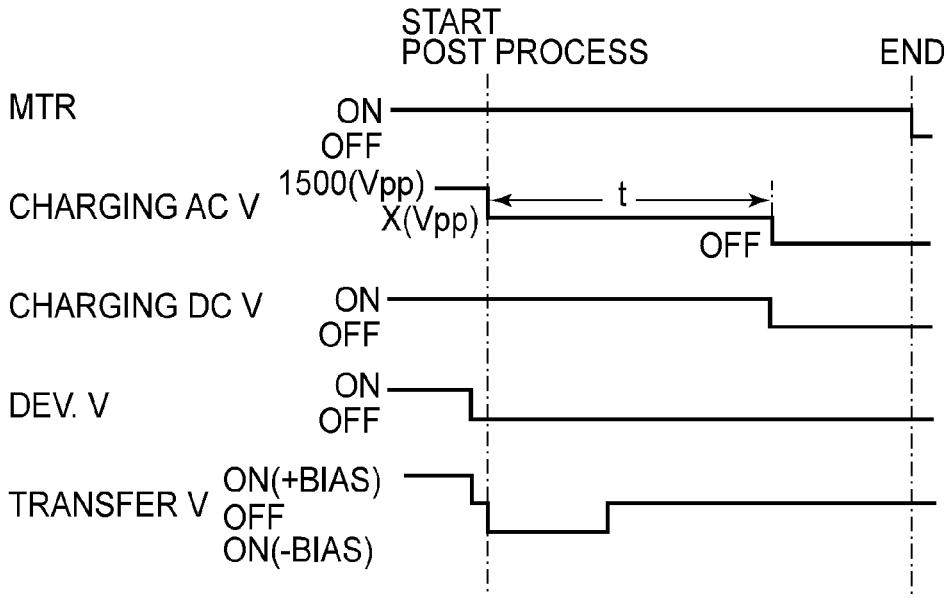
FIG. 1 is an operational chart which shows the operational sequence carried out by the image forming apparatus in the first embodiment, after the completion of an image.

Next, referring to FIG. 1, which is an operational sequence chart, the procedure carried out after the ending of the formation of an image in this embodiment will be described. The operational sequence which will be described next is the portion of the operational sequence, which is between the moment when the job started by the inputting of an image formation command is ended (image formation is ended) to the moment when the rotation of the photosensitive drum 1 is ended. More specifically, the timing with which the motor, charge voltage, development voltage, and transfer voltage are turned on or off after the ending of the formation of an image will be described. Incidentally, hereafter, the procedure carried out between when the job was completed and when the rotation of the photosensitive drum 1 stopped will be referred to as post-procedure. In the post-procedure, the photosensitive drum 1 is made uniform in the potential of the residual image thereon before the sheet of recording medium is conveyed through the fixing apparatus 109, and discharged therefrom. Further, the processes, such as expelling the toner on the transfer roller 107, for preparing the image forming apparatus for the next job are carried out. The development voltage is kept turned off. There are four processes in the post-procedure in this embodiment. The operational sequence chart, which will be described next, is controlled by the controller for controlling the operation of the image forming apparatus.

In this embodiment, prior to the starting of the post-procedure, a combination (first charge voltage) of an AC voltage which is higher in peak-to-peak voltage than the discharge start voltage, and a DC voltage, is applied to the charge roller 2. However, as soon as the post-procedure is started, the AC voltage to be applied to the charge roller 2 is switched to a voltage X (second charge voltage) which is lower in magnitude than the discharge start voltage. Further, during the portion of an image forming operation, in which an image is actually formed, a combination of an AC voltage which is 1,500 V in peak-to-peak voltage, and a DC voltage, is applied to the charge roller 2. The length of time the voltage X is continuously applied to the charge roller 2 during the post-procedure is assumed to be t (second).

As a length t of time elapses after the post-procedure is started, the AC voltage being applied to the charge roller 2 is turned off, and then, the rotation of the photosensitive drum 1 is stopped. In the case of the operational sequence shown in FIG. 1, the DC voltage also was turned off. However, the timing with which the DC voltage is to be turned off may be right after the post-procedure begins. Meanwhile, to the transfer roller 107, a voltage which is opposite in polarity to the voltage applied to the transfer roller 107 during the actual image forming operation is applied for a preset length of time, whereby the toner remaining adhered to the peripheral surface of the transfer roller 7 is made to transfer onto the photosensitive drum 1; the transfer roller 107 is cleaned.

Shown in Table 1, given below, are the results of the experiments in which the peripheral surface of the photosensitive drum 1 was observed to detect the presence or absence of black streaks and/or black bands, while varying in peak-to-peak voltage and length t (second) of application time, the AC voltage applied to the charge roller 2 during the post-procedure. The images were formed when the ambient temperature of the image forming apparatus was in a range of 5° C.-10° C. In Table, "○" (G) indicates the presence of no black streaks and no black bands; "Δ" (F) indicates the presence of a single slight streak (nonproblematic in terms of image appearance); and "X" (NG) indicates the presence of two or more streaks.

TABLE 1

| | t = 0.5 s | t = 1.0 s | t = 2.0 s | t = 3.0 s |
|---|---|---|---|---|
| X = 1600 V | X | X | X | X |
| X = 1400 V | X | X | X | X |
| X = 1200 V | X | X | X | X |
| X = 1100 V | X | Δ | Δ | Δ |
| X = 1000 V | ○ | ○ | ○ | ○ |
| X = 900 V | ○ | ○ | ○ | ○ |
| X = 800 V | ○ | ○ | ○ | ○ |
| X = 700 V | ○ | ○ | ○ | ○ |
| X = 600 V | ○ | ○ | ○ | ○ |
| X = 500 V | Δ | Δ | ○ | ○ |
| X = 400 V | X | X | X | X |
| X = 100 V | X | X | X | X |

The following are evident from Table 1. That is, in a case where t=0.5 (sec), (which corresponded to single full rotation of photosensitive drum 1, and during which AC voltage X was continuously applied), and the voltage X was in a range of 600 V-1,000 V, no vertical streak were found on the photosensitive drum 1 and sheet of recording medium. In a case where the voltage X was close to 1,100 V, which is close to the discharge start voltage, that is, the voltage level at and above which electric discharge occurs between the charge roller 2 and photosensitive drum 1, it was possible by extending the length t (sec) of time the AC voltage was applied to the charge roller 2, to prevent the occurrence of the vertical streak. On the other hand, in a case where the voltage X was low, whether or not it was possible to prevent the occurrence of the vertical streaks depended upon the value of the voltage X. For example, when the voltage X was 500 V, the prevention of the occurrence of the vertical streaks was possible by extending the length t (sec) of time the voltage X was applied. However, when the voltage X was 400 V, the prevention of the occurrence of the vertical streaks was impossible regardless of the length t (sec) of time the voltage X was applied; the vertical streaks remained at the level.

The following can be said about this embodiment, based on the results of the experiments given in Table 1.

If the AC voltage to be applied to the charge roller 2 is higher than the discharge starting signal (1,050 V), a certain amount of foreign substances (byproducts of photosensitive drum charging process) are formed on the peripheral surface of the photosensitive drum 1 by the electrical discharge. As a result, the peripheral surface of the photosensitive drum 1 increases in frictional resistance. On the other hand, the generation of the oscillatory electric field by the electrical discharge reduces the "stick-and-slip phenomenon". However, the byproducts of the charging of the photosensitive drum, which are formed on the peripheral surface of the photosensitive drum 1, are greater in effect than the reduction of the "stick-and-slip phenomenon" by the oscillatory electric field. Therefore, unsatisfactory images, more specifically, images which suffer from the vertical streaks and the like, are outputted. Thus, it is possible by applying an AC voltage which is no higher in peak-to-peak voltage than the discharge start voltage, to the charging member during the post-procedure, to continuously and satisfactorily clean the peripheral surface of the photosensitive member so that the formation of defective image are prevented.

However, if the AC voltage to be applied to the charge roller 2 is no higher than 400 V (peak-to-peak voltage), the oscillatory electric field generated by the AC voltage is relatively small, being therefore ineffective to satisfactorily prevent the cleaning member 5 from slicking-and-slipping. Therefore, unsatisfactory images are outputted. On the other hand, when the AC voltage applied to the charge roller 2 was 500 V (peak-to-peak voltage), and the length t (sec) of time the AC voltage was applied was relatively short (0.5 sec, 1.0 sec), the presence of slight streaks were confirmed. Thus, for the purpose of reducing the "stick-and-slip phenomenon" to a satisfactory level, the AC voltage to be applied to the charge roller 2 is desired to be no less than 600 V (peak-to-peak voltage).

It is evident from the results of the experiments described above that setting the AC voltage to be applied to the charge roller 2, to be no more in peak-to-peak voltage than the discharge start voltage, and no less than 600 V, makes it possible to continuously and satisfactorily clean the peripheral surface of the photosensitive drum so that unsatisfactory images will not be outputted. Setting the AC voltage to be applied to the charge roller 2, to be within the above-described range can reduce the amount by which foreign substances (byproducts) are formed by the electrical discharge, and therefore, can reduce the occurrence of the "slick-and-slip phenomenon". Incidentally, the length t of time the AC voltage is to be continuously applied to the charge roller 2 is desired to be no less than the length of time it takes for the photosensitive drum 1 to rotate one full turn (circumference of peripheral surface of photosensitive drum 1) (in this embodiment, no less than 0.5 sec).

The toner B also was subjected to the same tests as those to which the toner A was subjected. The results of the tests are given in Table 2.

TABLE 2

| | t = 1.0 s | t = 1.5 s | t = 2.0 s | t = 3.0 s |
|---|---|---|---|---|
| X = 1600 V | X | X | X | X |
| X = 1400 V | X | X | X | X |
| X = 1200 V | X | X | Δ | Δ |
| X = 1100 V | Δ | ○ | ○ | ○ |
| X = 1000 V | ○ | ○ | ○ | ○ |
| X = 900 V | ○ | ○ | ○ | ○ |
| X = 800 V | ○ | ○ | ○ | ○ |
| X = 700 V | ○ | ○ | ○ | ○ |
| X = 600 V | ○ | ○ | ○ | ○ |
| X = 500 V | ○ | ○ | ○ | ○ |
| X = 400 V | X | Δ | ○ | ○ |
| X = 100 V | X | X | X | X |

The toner B was wider than the toner A, in terms of the voltage X (peak-to-peak voltage) range in which the cleaning failure does not occur, and also, the range of the length t of time. This is attributable to the fact that the toner A is virtually spherical in particle shape, whereas the toner B is not smooth in terms of particle surface. In other words, this is attributable to the fact that it is more difficult for the toner B to slip through the interface between the cleaning member 5 and the peripheral surface of the photosensitive drum 1 than the toner A. That is, the toner B is different from the toner A in the latitude regarding the range of the AC voltage to be applied to the charging member to prevent the image forming apparatus from outputting images which suffer from vertical streaks.

As described above, images of satisfactory quality can be obtained, regardless of toner type, by applying to the charge roller 2, a combination of a DC voltage, and such an AC voltage that is no higher in peak-to-peak voltage than the discharge start voltage between the charge roller 2 and peripheral surface 1, and no lower than 600 V, during the post-procedure.

Incidentally, if an AC voltage which is higher than the discharge start voltage is applied to the charge roller 2, noises (charging noises) are sometimes generated. In this embodiment, however, the AC voltage applied to the charge roller 2 during the post-procedure is no higher than the discharge start voltage. Therefore, it is unlikely for noises (charging noises) to be generated during the post-procedure.

As described above, the present invention makes it possible to provide an image forming apparatus which employs a charging member to which a combination of AC and DC voltages are applied, and a photosensitive drum cleaning member, and yet, does not fail to satisfactorily clean the photosensitive drum, and therefore, can always output high quality images.

[Embodiment 2]

Next, referring to FIG. 5, the image forming apparatus in the second preferred embodiment of the present invention will be described. In the first embodiment, it was only during the post-procedure, that is, the procedure subsequent to the ending of the image formation, that an AC voltage was applied to the charge roller 2 for a preset length of time. In this embodiment, however, an AC voltage is applied to the charge roller 2 not only during the post-procedure, but also, during the "preparatory procedure". The "preparatory procedure" means the portion of an image forming operation, which corresponds to the period from when the motor of the image forming apparatus is turned on to when the development voltage is turned on, that is, when an image begins to be formed.

Continuously applying the same AC voltage as the AC voltage applied, in combination with a DC voltage, to the charge roller 2 during both the post-procedure and preparatory procedure is also effective to reduce the stick-and-slip phenomenon. However, it allows the byproducts of the charging of the photosensitive drum, to be generated during the periods in which no image is formed, more specifically, during the post-procedure and preparatory procedure. Therefore, this method is not desirable from the standpoint of environmental concerns. Further, it results in the formation of defective (unsatisfactory) images, the defects of which is attributable to the byproducts of the electrical discharge, and also, the generation of charging noises. In comparison, the AC voltage which is applied to the charging member during the post-procedure and preparatory procedure in this embodiment is no higher in peak-to-peak voltage than the discharge start voltage. Therefore, it is unlikely for unwanted substances (byproducts) to be formed on the peripheral surface of the photosensitive drum 1.

(2-1: Control Sequence)

Next, referring to FIG. 5 which is an operational chart, the control sequence related to the present invention will be described. First, an AC voltage which is no higher in peak-to-peak voltage than the discharge start voltage, and no lower in peak-to-peak voltage than 600 V begins to be applied to the charge roller 2 at the starting of the post-procedure. The length t of time the AC voltage is applied is no less than the length of time it takes for the photosensitive drum 1 to rotate one full turn, as described above.

After the continuous application of the above described AC voltage to the charge roller 2, the rotation of the photosensitive drum 1 is stopped, and the motor is turned off, ending thereby the post-procedure. Then, as an image formation start signal for the next job is inputted, the motor is turned on, starting thereby the preparatory procedure for the next job. During this preparatory period, the image forming apparatus is prepared for image formation. The preparatory operation is for stabilizing the scanner unit 101 in terms of turning on or off its laser, making the photosensitive drum 1 uniform in peripheral surface potential, increasing the fixing apparatus 109 in temperature to a preset level, which are necessary for the formation of satisfactory images.

During the preparatory operation (preparatory procedure), an AC voltage which is no higher in peak-to-peak voltage than the discharge start voltage, begins to be applied to the charge roller 2 at the same time as the photosensitive drum 1 begins to be rotationally driven.

Then, in order to ensure that the photosensitive drum 1 remains stable in the potential level to which it is charged, an AC voltage (1,500 V in this embodiment) which is no lower in peak-to-peak voltage than the discharge start voltage begins to be applied to the charge roller 2 to charge the peripheral surface of the photosensitive drum 1 one full rotation of photosensitive drum 1 before the starting of image formation. That is, in the preparatory procedure in this embodiment, an AC voltage which is no higher in peak-to-peak voltage than the discharge start voltage is applied to the charge roller 2 from when the photosensitive drum 1 begins to be rotated, to when an AC voltage which is higher in peak-to-peak voltage than the normal discharge start voltage begins to be applied to the charge roller 2.

In the case of the image forming apparatus in this embodiment, when an AC voltage which was no lower in peak-to-peak voltage than 500 V was applied to the charge roller 2, the apparatus did not output unsatisfactory images, more specifically, images suffering from defects such as vertical streaks, vertical bands, etc. The reason why the AC voltage which was no lower in peak-to-peak voltage was applied to the charge roller 2 was that if the AC voltage X (to be applied to the charge roller 2) is no higher in peak-to-peak voltage than 400 V, the cleaning member 5 cannot be satisfactorily prevented from "slicking and slipping", as described above.

As described above, the present invention makes it possible to provide an image forming apparatus which applies a combination of an AC voltage and a DC voltage to its charge roller(s), and is equipped with a cleaning member, and yet, does not fail to satisfactorily clean its photosensitive drum(s), and therefore, can output high quality images.

[Miscellaneous Embodiments]

The image forming apparatuses in the preceding embodiments were such image forming apparatuses that transfer a toner image directly from the photosensitive drum 1 onto recording medium. However, the present invention is also applicable to image forming apparatuses of the intermediary transfer type, that is, such image forming apparatuses that transfer a toner image from their photosensitive drums 1 onto their intermediary transfer mediums, and then, from the intermediary transfer medium, onto the sheet of recording medium. The effects of the application of the present invention to the image forming apparatuses of the intermediary transfer type are the same as those of the application of the present invention to image forming apparatuses in the preceding embodiments. In the case of image forming apparatuses of the intermediary transfer type, the "medium onto which a toner image is transferred from the photosensitive drum 1" is the intermediary transfer medium.

In the first embodiment, an AC voltage was applied, in combination with a DC voltage, to the charge roller 2 in the post-procedure, whereas in the second embodiment, an AC voltage was applied in combination with a DC voltage to the charge roller 2 in preparatory procedure, as well as in the post-procedure. However, the timing with which an AC voltage is applied to the charge roller 2 may be only in the preparatory procedure for each printing job. That is, as long as an AC voltage, the peak-to-peak voltage of which is in the above described range, is applied in combination with a DC voltage to the charging member at least in the preparatory or post-procedure, the cleaning member does not fail to satisfactorily clean the photosensitive drum 1, and therefore, images of good quality can be obtained.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 206665/2009 filed Sep. 8, 2009 which is hereby incorporated by reference.

What is claimed is:

1. An image forming apparatus comprising:

a rotatable image bearing member for carrying a toner image;

a charging member for contacting a surface of said image bearing member to discharge the surface;

a cleaning blade for contacting the surface of said image bearing member to remove toner remaining on the surface of said image bearing member after a toner image is transferred from said image bearing member onto a transfer material; and a control device for controlling a voltage applied to said charging member, wherein said control device applies to said charging member a first charged potential which includes a peak-to-peak voltage larger than a discharge starting voltage in an image forming operation, and applies to said charging member a second voltage which includes a peak-to-peak voltage smaller than the discharge starting voltage, for at least one full rotation of said image bearing member, after completion of the image forming operation and before an AC voltage component applied to said charging member is shut off.

2. An apparatus according to claim 1, wherein said control device applies the second voltage to said charging member after start of rotation of said image bearing member and before the image forming operation.

3. An apparatus according to claim 1, wherein the peak-to-peak voltage of the second potential is not less than 600V.

* * * * *